US006244440B1

(12) United States Patent
Tschantz et al.

(10) Patent No.: US 6,244,440 B1
(45) **Date of Patent: *Jun. 12, 2001**

(54) INFLATABLE PACKAGING CUSHION

(75) Inventors: Michell Tschantz, Newtown, CT (US); Jeffrey Goodner, Denver, CO (US)

(73) Assignee: IPI, Inc., Newtown, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/340,311

(22) Filed: Jun. 28, 1999

(51) Int. Cl.[7] ..... B65D 81/02

(52) U.S. Cl. ..... 206/522; 206/521; 206/588; 206/591; 383/3; 428/71

(58) Field of Search ..... 206/522, 521, 206/588, 591, 592; 383/3; 428/71

(56) References Cited

U.S. PATENT DOCUMENTS 5,769,231 * 6/1998 Batsford ..... 206/522
5,803,263 * 9/1998 Pozzo ..... 206/522
5,912,058 * 6/1999 Takahashi et al. ..... 428/34.3

* cited by examiner

*Primary Examiner*—Paul T. Sewell
*Assistant Examiner*—Troy Arnold
(74) *Attorney, Agent, or Firm*—Ware, Fressola, Van der Sluys & Adolphson LLP

(57) ABSTRACT

An inflatable cushion for surrounding a product to be shipped. The cushion is of a raft-like design having individual compartments adopted to be inflated. Provision is made to fold the cushion to provide upright sides and a top portion so that the cushion will conveniently surround the product on all surfaces.

6 Claims, 2 Drawing Sheets

INFLATABLE PACKAGING CUSHION

BACKGROUND OF THE INVENTION

The present invention relates to inflatable cushion packaging material.

In the normal mailing or other transportation items are customarily packaged in an outer container leaving voids between the product and its container which must be filled to protect the product during shipment. One manner of filling these voids is by inflatable cushions. An example of such inflatable devices is found in U.S. Pat. No. 5,348,157. As seen in that patent the inflatable cushions can take various forms for surrounding portions of the product being shipped.

The inflatable cushions of the prior art have the disadvantage of being of elaborate designs often requiring openings passing through the cushion and generally being of custom design for a particular product. The present invention on the other hand is of a simple design that is readily and conveniently manufactured and may be utilized for a large variety of shapes and sizes of products being packaged.

An important feature of an inflatable cushion is that it not rupture upon impact. Rupture would of course result in deflation and loss of the cushioning effect.

SUMMARY OF THE INVENTION

The inflatable cushion of the present invention is in the configuration of a flat raft-like design having individual compartments. Most of the compartments are joined by air passages so that a single valve would serve to inflate the cushion. Provision is made to conveniently fold the cushion to provide upright sides and a top member so that the cushion will conveniently surround the product being shipped on various surfaces of the product.

The invention contemplates inflatable compartments protecting all sides of a product for complete protection. In addition the top and bottom cushions each have a portion that is noninflatable that provides improved cushioning and resistance to rupture in the event of impact.

Accordingly it is an object of the present invention is to provide an inflatable cushion that may be folded or configured to surround all sides of a product for shipment.

A further object of the present invention is to provide a flat inflatable cushion that may be readily folded to surround a product for packaging and shipment.

A further object of the invention is to provide an inflatable cushion in which selected surfaces have both inflated and non-inflated portions for improved cushioning.

A further object of the invention is to provide an inflatable cushion having six sides with inflatable compartments in which two opposite sides have noninflatable portions for improved cushioning.

BRIEF DESCRIPTION OF THE DRAWINGS

The foregoing and still other objects and advantages of the present invention will be more apparent from the following detailed explanation of the preferred embodiments of the invention considered in connection with the accompanying drawings in which.

DESCRIPTION OF THE PREFERRED EMBODIMENTS

Figure 1:
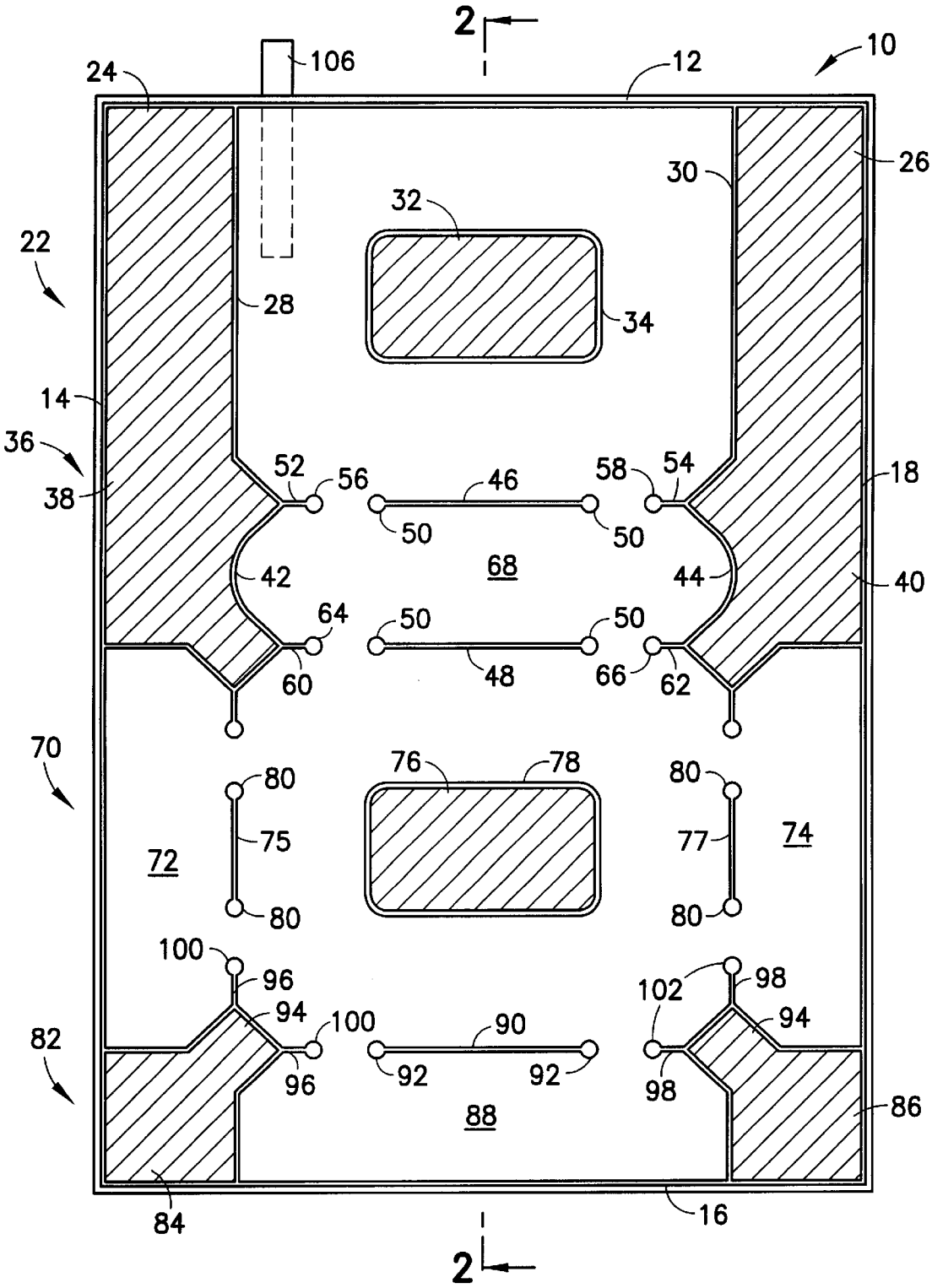
FIG. 1 is a plan view of the packaging cushion of the present invention in its unfolded condition.
Figure 2:
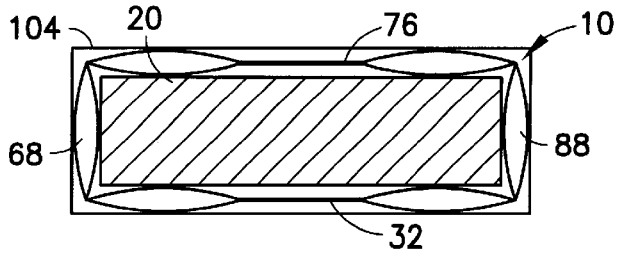
FIG. 2 is a cut away side view of the packaging cushion of FIG. 1 used to surround a product.

Referring now to the drawings and more particularly to FIGS. 1 and 2, numeral 10 designates the inflatable cushion of the present invention which is formed of two sheets of material in the form of a square or rectangle. The sheets may be of any plastic or other suitable material that is flexible, pliable, and impervious to air. The two sheets are fused together along their four outer edges 12, 14, 16 and 18 in order to form an air impermeable envelope. The sheets are also fused in a pattern at spots and segmented seams which form the sides of various compartments as hereinafter described.

The cushion is designed to conveniently fold around a product 20 as seen in FIG. 2. This is accomplished by providing the cushion 10 with a certain unique design of deflated areas shown by the cross hatching in FIG. 1 and inflated areas. These areas are effected by various seams and spots at which the two sheets are fused.

A first portion 22 of the cushion has deflated ends 24, 26 partially formed by fused seams 28, 30. A deflated central rectangular area 32 is provided in cushion portions 22 by a fused edge 34.

An second portion 36 of the cushion is provided to protect the end of product 20 and in the embodiment shown the cushion portion 36 protects the left end of the encircled product as seen in FIG. 2.

The extreme areas of second portion 36 are deflated as at 38, 40 by seams 42, 44 which are extentions of seams 28, 30 respectfully. It is seen then that extreme areas 38, 40 of portion 36 are joined to deflated ends 22, 26 of the first portion 22. The second portion 36 is completed by seams 46, 48 terminating in spots 50. Seam 46 is aligned with extention seams 52, 54 terminating in spots 56, 58 extending from deflated areas 38, 40 respectively. Similarly, seam 48 is aligned with extension seams 60, 62 terminating in spots 64, 66 which also extend from deflated areas 38, 40 respectfully. The inflated area 68 between seams 46, 48 as seen in FIG. 2 provides cushioned protection for the left end of the product 20 being shipped.

A third portion 70 of cushion 10 has inflated ends 72, 74 and a deflated center 76 formed by fused seam 78. The ends 72, 74 are defined by portions of the fused seams 14, 18 and the parallel seams 76, 78 that terminate in fused spots 80. As seen in FIG. 2, the portion 70 of cushion 10 is positioned on the top of product 20 to protect it by the cushioning effect.

A fourth portion 82 of cushion 10 has two deflated extreme ends 84, 86 and an inflated area 88 between them. The inflated area is defined by a portion of seam 16 and seam 90 terminating in fused spots 92. Each of the deflated ends 84, 86 have deflated tabs 94 extending diagonally inward as seen in FIG. 1 and each said tab has two extending seams 96, 98 extending therefrom terminating in spots 100, 102. As seen in FIG. 2, the cushion portion 82 protects the right end of product 20. Thus the product is fully protected within its shipping container 104 being secured in place by cushion 10 on the four sides of the product as above described. The additional two sides of the product which may be designated the front and back in the FIG. 2 orientation are protected by inflated ends 72, 74 of the described thrid portion 70 of cushion 10. These inflated ends are not shown in the section view of FIG. 2.

The cushion is inflated by air under pressure injected through valve 106 which connects to all of the inflated areas of the cushion.

Figure 3:
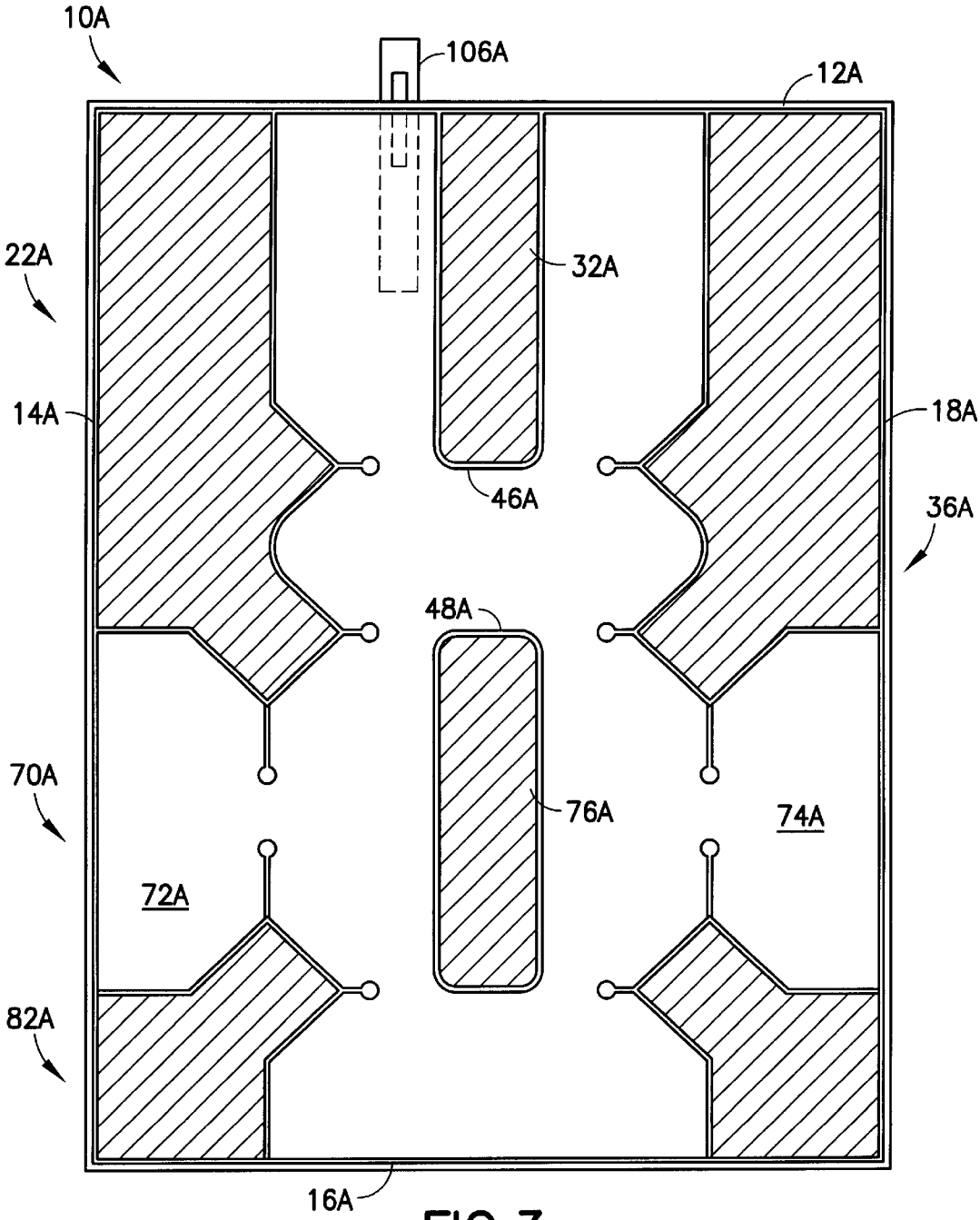
FIG. 3 is a modification of the embodiment of FIG. 1.

Referring now to FIG. 3 there is shown a modification of the embodiment of FIG. 1. Here again there are two sheets fused along the edges at 12A, 14A, 16A and 18A to form an air impermeable envelope or cushion 10A. The cushion has deflated areas and inflated areas somewhat similar to FIG. 1. However the central rectangular deflated areas 32A and 76A of first cushion portion 22A and third cushion portion 70A are oriented in a direction 90 degree from that of the corresponding areas 32 and 76 of FIG. 1. Thus the seams 46 and 48 of FIG. 1 defining the sides of the second cushion portion 36 are eliminated in the FIG. 3 embodiment. Serving in their place are the end seams 46A, 48A of areas 32A and 76A.

The cushion 10A is inflated through a valve 106A and encircles a product in a manner similar to cushion 10 in FIG. 2. Thus the four portions of cushion 10A designated 22A, 36A, 70A and 82A would protect the top, bottom and ends of a product and inflated areas 72A and 74A of area 70A would cushion the front and back of the product.

Having thus described the invention with particular reference to the preferred forms thereof, it will be obvious that various changes and modifications may be made therein without departing from the spirit and scope of the invention as defined in the appended claims.

What is claimed is:

1. An inflatable packging cushion comprising:

two substantially air impermeable rectangular sheet means of substantially equal size;

sealing means joining said two sheet means along their perepheries to form an impermeable rectangular cushion;

valve means secured to said cushion to permit air to enter and exit therefrom;

means forming a plurality of compartments within the inflatable cushion;

said rectangular cushion having first, second, third and fourth areas;

said first area having two deflated end compartments;

said second area having two deflated end compartments and an intermediate inflatable portion;

said third area having two inflatable end compartments and an intermediate inflatable portion;

said first, second, third and fourth areas being adapted to be folded over four sides of a product to be protected and the inflatable end compartments of said third portion being adapted to be folded over the two ends of the product.

2. The inflatable cushion set forth in claim 1 in which said first and third cushion areas each have a deflated compartment in the center thereof.

3. The inflatable cushion set forth in claim 2 in which said fourth cushion area has two deflated end compartments and an intermediate inflatable area.

4. An inflatable packaging cushion comprising:

two substantially air impermeable rectangular sheet means of substantially equal size;

sealing means joining said two sheet means along their peripheries to form an impermeable rectangular cushion;

valve means secured to said cushion to permit air to enter and exit therefrom;

means forming a plurality of compartments within the inflatable cushion;

said rectangular cushion having first, second, third and fourth areas;

said first area having two deflated end compartments and an intermediate inflatable area;

said second area having two deflated end compartments and an intermediate inflatable portion;

two parallel seams at the sides of said second area intermediate inflatable portion;

the respective deflated end compartments of the first area and second area being joined;

said third area having two inflatable end compartments and an intermediate inflatable portion;

each of the third area end compartments having a seam separating it from the third area intermediate inflatable portion;

said first, second, third and fourth areas being adapted to be folded over four sides of a product to be protected and the inflatable end compartments of said third portion being adapted to be folded over the two ends of the product.

5. The inflatable cushion set forth in claim 4 in which said first and third cushion areas each have a deflated compartment in the center thereof.

6. The inflatable cushion set forth in claim 5 in which said fourth cushion area has two deflated end compartments and an intermediate inflatable area.

* * * * *